US009784139B2

(12) United States Patent
Shaffer et al.

(10) Patent No.: US 9,784,139 B2
(45) Date of Patent: Oct. 10, 2017

(54) COMPACT ENERGY CYCLE CONSTRUCTION UTILIZING SOME COMBINATION OF A SCROLL TYPE EXPANDER, PUMP, AND COMPRESSOR FOR OPERATING ACCORDING TO A RANKINE, AN ORGANIC RANKINE, HEAT PUMP, OR COMBINED ORGANIC RANKINE AND HEAT PUMP CYCLE

(71) Applicants: Robert W. Shaffer, Broomfield, CO (US); Bryce R Shaffer, Broomfield, CO (US)

(72) Inventors: Robert W. Shaffer, Broomfield, CO (US); Bryce R Shaffer, Broomfield, CO (US)

(73) Assignee: Air Squared, Inc., Broomfield, CO (US)

( * ) Notice: Subject to any disclaimer, the term of this patent is extended or adjusted under 35 U.S.C. 154(b) by 127 days.

(21) Appl. No.: 14/756,594

(22) Filed: Sep. 22, 2015

(65) Prior Publication Data

US 2016/0069219 A1 Mar. 10, 2016

Related U.S. Application Data

(63) Continuation of application No. 13/986,349, filed on Apr. 23, 2013, now abandoned, which is a (Continued)

(51) Int. Cl.
*F01K 11/04* (2006.01)
*F01K 13/02* (2006.01)
(Continued)

(52) U.S. Cl.
CPC ..... *F01K 13/02* (2013.01); *F01C 1/0215* (2013.01); *F01C 1/0269* (2013.01);
(Continued)

(58) Field of Classification Search
CPC ..... F01K 11/02; F01K 11/04; F01K 13/00; F01K 13/006
(Continued)

(56) References Cited

U.S. PATENT DOCUMENTS 2,079,118 A 5/1937 Hingst
2,330,121 A 9/1943 Heintz
(Continued)

FOREIGN PATENT DOCUMENTS

DE 19957425 A1 8/2000
GB 1575684 A * 9/1980 ..... F24J 2/10
WO WO/2004/008829 1/2004

*Primary Examiner* — Laert Dounis
(74) *Attorney, Agent, or Firm* — Paul M. Denk

(57) ABSTRACT

A compact energy cycle construction that operates as or in accordance with a Rankine, Organic Rankine, Heat Pump, or Combined Organic Rankine and Heat Pump Cycle, comprising a compact housing of a generally cylindrical form with some combination of a scroll type expander, pump, and compressor disposed therein to share a common shaft with a motor or generator and to form an integrated system, with the working fluid of the system circulating within the housing as a torus along the common shaft and toroidally within the housing as the system operates.

12 Claims, 6 Drawing Sheets

Related U.S. Application Data continuation-in-part of application No. 13/507,779, filed on Jul. 30, 2012, now Pat. No. 9,074,598.

(60) Provisional application No. 61/687,464, filed on Apr. 25, 2012.

(51) Int. Cl.

| | |
|---|---|
| ***F04C 18/02*** | (2006.01) |
| ***F01K 13/00*** | (2006.01) |
| ***F01C 1/02*** | (2006.01) |
| ***F25B 1/04*** | (2006.01) |
| ***F01C 11/00*** | (2006.01) |
| ***F04C 23/00*** | (2006.01) |
| ***F04C 29/02*** | (2006.01) |
| ***F04C 29/04*** | (2006.01) |
| ***F25B 30/02*** | (2006.01) |
| *F25B 11/04* | (2006.01) |

(52) U.S. Cl.

CPC ..... *F01C 11/006* (2013.01); *F01K 11/04* (2013.01); *F01K 13/00* (2013.01); *F04C 18/0215* (2013.01); *F04C 18/0269* (2013.01); *F04C 23/008* (2013.01); *F04C 29/023* (2013.01); *F04C 29/042* (2013.01); *F25B 1/04* (2013.01); *F25B 30/02* (2013.01); *F25B 11/04* (2013.01)

(58) Field of Classification Search

USPC ..... 418/55.1–55.6; 60/643–681; 165/163, 165/DIG. 348, DIG. 351; 417/410.5, 310; 62/238.6, 238.7

See application file for complete search history.

(56) References Cited

U.S. PATENT DOCUMENTS

| | | | | |
|---|---|---|---|---|
| 2,968,157 | A * | 1/1961 | Cronan | F01D 15/02 60/669 |
| 3,470,704 | A * | 10/1969 | Kantor | F01K 11/04 62/115 |
| 3,613,368 | A | 10/1971 | Doemer | |
| 3,999,400 | A * | 12/1976 | Gray | F01D 5/088 165/104.25 |
| 4,069,673 | A * | 1/1978 | Lapeyre | F01K 11/04 290/1 A |
| 4,395,885 | A | 8/1983 | Cozby | |
| 4,511,091 | A | 4/1985 | Vasco | |
| 5,214,932 | A * | 6/1993 | Abdelmalek | B01D 53/002 60/651 |
| 6,464,467 | B2 * | 10/2002 | Sullivan | F01C 11/002 417/295 |
| 7,124,585 | B2 | 10/2006 | Kim et al. | |
| 7,249,459 | B2 | 7/2007 | Hisanaga et al. | |
| 7,458,414 | B2 | 12/2008 | Simon | |
| 7,836,696 | B2 * | 11/2010 | Uno | B60H 1/3214 418/55.1 |
| 7,980,078 | B2 * | 7/2011 | McCutchen | F28D 15/0233 60/645 |
| 8,087,260 | B2 * | 1/2012 | Ogata | F01C 1/3442 62/401 |
| 8,484,974 | B1 * | 7/2013 | Monson | F02C 1/05 60/641.8 |
| 8,674,525 | B2 | 3/2014 | Van Den Bossche et al. | |
| 2002/0011332 | A1 | 1/2002 | Oh et al. | |
| 2004/0020206 | A1 * | 2/2004 | Sullivan | F01C 1/0215 60/670 |

* cited by examiner

COMPACT ENERGY CYCLE CONSTRUCTION UTILIZING SOME COMBINATION OF A SCROLL TYPE EXPANDER, PUMP, AND COMPRESSOR FOR OPERATING ACCORDING TO A RANKINE, AN ORGANIC RANKINE, HEAT PUMP, OR COMBINED ORGANIC RANKINE AND HEAT PUMP CYCLE

CROSS REFERENCE TO RELATED APPLICATIONS

This continuation patent application claims priority to the patent application having Ser. No. 13/986,349, filed on Apr. 23, 2013, which claims priority to the provisional patent application having Ser. No. 61/687,464, filed on Apr. 25, 2012, which claims priority as a continuation-in-part patent application to the patent application having Ser. No. 13/507,779, filed on Jul. 30, 2012, now Publication No. US 2013-0036762 A1, which claims priority to the provisional patent application having Ser. No. 61/574,771, filed Aug. 9, 2011.

FIELD OF THE INVENTION

The present invention is directed to an energy cycle construction, several rotating components of which are integrated within a compact container housing to share a common shaft along which working fluid transits as the construction operates.

The container housing is preferably of a generally cylindrical configuration with some combination of a scroll type expander, pump, and compressor disposed therein to form an integrated system, with the working fluid of the system circulating about a torus in the poloidal direction.

The assembled construction may operate generally as or in accordance with a Rankine Cycle, an Organic Rankine Cycle (ORC), a Heat Pump Cycle, an air conditioning or refrigeration cycle, or a Combined Organic Rankine and Heat Pump or refrigeration Cycle.

BACKGROUND OF THE INVENTION

Rankine Cycles, Organic Rankine Cycles (ORC), and Refrigeration/Heat Pump Cycles are well known, and many systems of various designs have been developed over the years to operate in accordance with such cycles. For convenience of further reference, such cycles will often hereinafter be referred to generically as energy cycles. Principles of operation of such energy cycles have been addressed in detail in numerous prior publications, and operations of various systems in accordance with such energy cycles are also explained in numerous prior art publications. For convenience of further reference, such systems or constructions are often hereinafter referred to as energy cycle constructions.

Although such energy cycle constructions may take many forms, it has been found advantageous in many instances to employ multiple rotating components as components of such energy cycle constructions to effect the desired energy cycles while realizing advantages attendant to the use of such rotating components. Such rotating components may include not only rotary equipment such as generators and motors, but also other rotary devices such as expanders, pumps, and compressors, as well as scroll type devices that include both compressor and expander functions such as are disclosed in U.S. Provisional Patent Application Ser. No. 61/574,771, filed Aug. 9, 2011. For convenience of further reference, such other rotary devices and the like are often hereinafter referred to generically as working fluid treatment devices, and reference to energy cycle devices is intended to encompass motors and generators and like equipment in addition to working fluid treatment devices, especially as they may be utilized in energy cycle constructions.

Many energy cycle constructions are thus configured to operate as or in accordance with a Rankine Cycle, an Organic Rankine Cycle (ORC), and/or a Refrigeration/Heat Pump Cycle, and to employ one or more, and often two, rotary working fluid treatment devices, often of a scroll type design, as part of their systems. Generally, many such rotary based energy cycle constructions share a common set up in that they include two rotary working fluid treatment devices as well as an evaporator and condenser, and a motor or generator. Typically, such energy cycle constructions are constructed with the individual components thereof interconnected to form the completed system, but with each of such individual components existing as a separate independent component in a closed loop connected via piping. Due to the independence and separateness of such components, such completed or assembled energy cycle constructions have necessarily been of larger size.

For many reasons, it would generally be desirable if the sizes, and cost of such energy cycle constructions could be decreased or minimized, and the reliability improved. To this point in time, however, that desire has remained largely unsatisfied.

SUMMARY OF THE INVENTION

This invention has thus been developed to result in a more compact, lower cost, and more reliable energy cycle construction. The resulting construction integrates system components into a closed, preferably cylindrical, container housing, sometimes hereinafter referred to more simply as the container, within which container housing the working fluid flows about a torus in the poloidal direction. The rotary working fluid treatment devices utilize a scroll type design and rotate about a common shaft, with the evaporation and condensing processes being affected while the fluid is in transit between the rotary fluid treatment devices. This type of system design can be advantageously used for power generation through the use of a Rankine Cycle or ORC, or can be used for heat pumping through the use of a Refrigeration/Heat Pump Cycle, sometimes hereinafter referred to more simply as a Heat Pump Cycle or a Refrigeration Cycle.

In the following explanation of the invention, the word "Scroll" can refer to either the traditional orbiting scroll design, or to what is commonly referred to as a Spinning or Co-rotating scroll design.

For power generation, a preferred embodiment employs five (5) major components within the container housing, including an expander, generator, pump, condenser, and evaporator. A scroll expander is used to extract power from the working fluid and move it into the condenser, while a scroll liquid pump, or other rotating liquid pump, such as a gear or vane pump, is used to pump the working fluid through the evaporator. The pump, expander, and generator are aligned on the same shaft, with the evaporation process occurring inside the shaft and the condensation process occurring along the containment shell of the container housing. The end result of such preferred embodiment is the production of electrical energy by moving heat from a high temperature source to a low temperature source.

For an ORC, refrigerant can be used as the working fluid to extract heat from a variety of waste heat applications, such as solar power, geothermal, or waste heat from power production or manufacturing processes. For a Rankine Cycle, steam can be used as the working fluid to extract heat from burning fossil fuels or high temperature geothermal.

For heat pumping/refrigeration, a preferred embodiment also employs five (5) major components within the container housing, including a compressor, motor, expander, condenser, and evaporator, although the expander could be replaced with a capillary tube or expansion valve as used in a traditional heat pump/refrigeration cycle. A scroll compressor is used to compress the working fluid from the evaporator and to supply it to the condenser, while a scroll expander is used to expand the liquid from the condenser and to supply it as a two-phase gas to the evaporator. The expander, compressor, and motor are located on the same shaft, with the condensation process occurring inside the shaft and the evaporation process occurring along the containment shell of the container housing. The end result of such preferred embodiment is the use of electrical energy to move heat from a low temperature source to a high temperature source.

For a heat pump cycle, refrigerant can be used as the working fluid to move heat from ambient air to a heated area. For a refrigeration cycle, refrigerant can be used to remove heat from a cooled area to the ambient air.

Another system variation can be readily realized through the integration into a common construction of both an ORC and a refrigeration cycle, with the ORC being utilized to power the refrigeration cycle. Depending upon the net power difference, either a generator (excess power generated from ORC) or motor (deficiency in power generation from ORC) or combination motor and generator can be used. A preferred form of such system includes six (6) major components within the container housing, including a compressor-expander, a motor/generator, a pump-expander, high and low pressure evaporator portions, and a condenser, certain components of which may be designed to operate in accordance with U.S. Provisional Patent Application Ser. No. 61/574,771, filed Aug. 9, 2011.

In such system, the compressor-expander has two functions: on the outer portion of such compressor-expander refrigerant from the low pressure evaporator is compressed to be provided to the intermediate pressure condenser; on the inner portion of such compressor-expander refrigerant from the high pressure evaporator is expanded to be provided to the intermediate pressure condenser. The pump-expander also has two functions: on the outer portion of such pump-expander liquid refrigerant from the intermediate pressure condenser is expanded to be provided to the low pressure evaporator; on the inner portion of the pump-expander the liquid refrigerant from the intermediate pressure condenser is pumped to the high pressure evaporator. The compressor-expander, motor/generator, and pump-expander are all located on the same shaft. The high pressure evaporation process occurs inside the hollow shaft while the intermediate pressure condensation process occurs along the inside of the containment shell. The low pressure evaporation process occurs in an evaporator external to the containment shell inside a cooled space.

The present invention may thus be encompassed within and practiced by various constructions that incorporate all the rotary components within a single container housing, including systems such as the three (3) unique, preferred constructions noted hereinabove. Such design decreases the risk of refrigerant leakage, reduces overall system cost, due to the integration of components, and simplifies the energy cycle, which increases reliability, by eliminating all piping between components.

In addition, the unique design of such systems increases system efficiency and decreases system complexity, including by placing all the rotating equipment on a single shaft. For a refrigeration/heat pump cycle the design increases efficiency by replacing an expansion valve with an expander to recover power in the expansion process.

Although the preferred construction is described here, it may be necessary in some cases to place some of the components discretely in some ORC, heat pump and refrigeration cycle applications. Such alternate configurations are obvious and included herein.

DESCRIPTION OF THE PREFERRED EMBODIMENT

Figure 1:
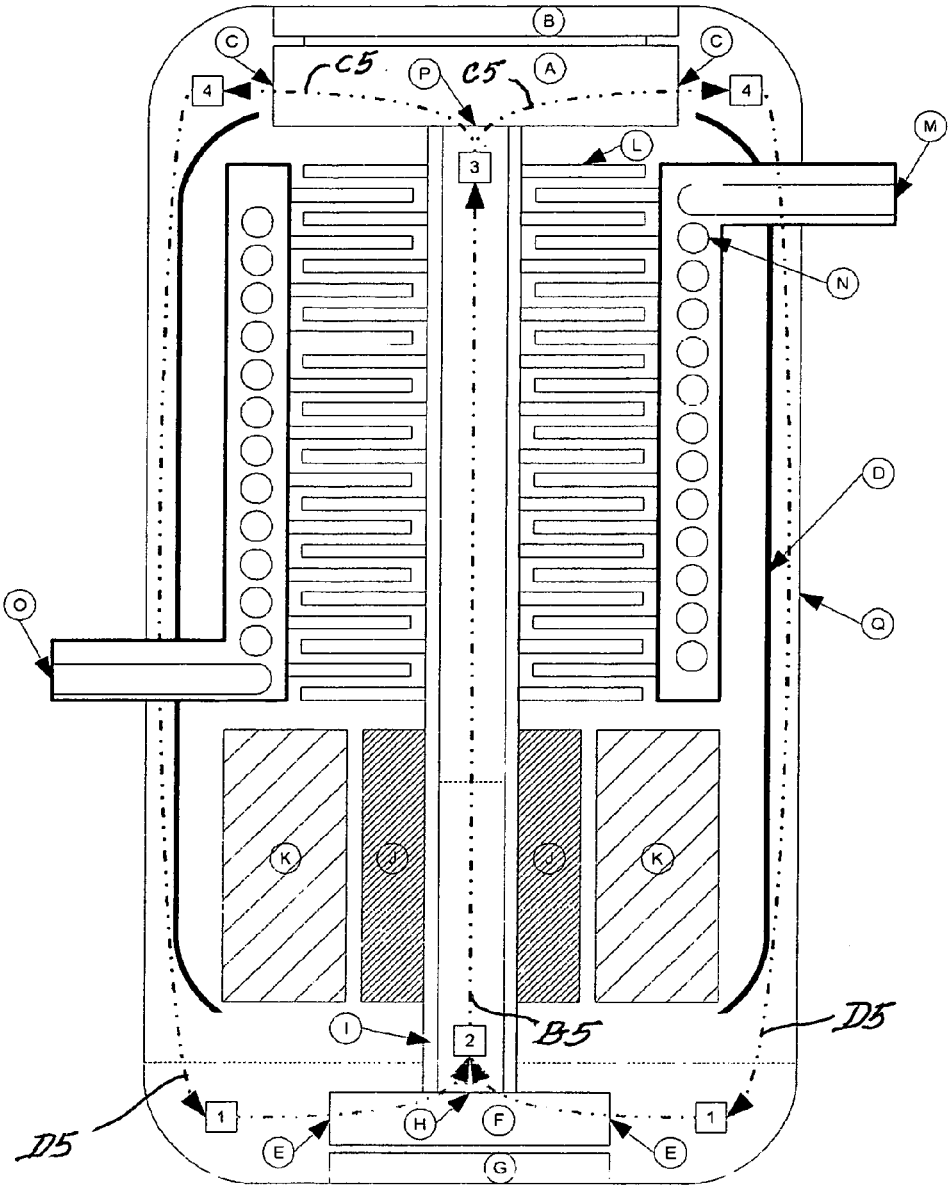
FIG. 1 depicts a preferred embodiment of the present invention incorporated within a compact housing, operating as or in accordance with a Rankine Cycle or Organic Rankine Cycle (ORC)

With reference now to the drawings, where like identification symbols in any given figure refer to like items, but where such identification symbols may vary from figure to figure, FIG. 1 depicts an embodiment according to the present invention, operating as or in accordance with a Rankine Cycle or Organic Rankine Cycle, with components and features of such embodiment having the identification symbols as set forth in the following Table 1:

TABLE 1

FIG. 1 Identifiers

| Identifier | Item Description |
|---|---|
| | Components (Alphabetized circles) |
| A | Orbiting portion of the orbital scroll expander, or driving portion of a co-rotating scroll expander |
| B | Fixed portion of the orbital scroll expander, or driven portion of a co-rotating scroll expander |
| C | Scroll expander Outlet |
| D | Insulation/sealing between condenser and rotating equipment |
| E | Scroll pump inlet |
| F | Driving portion of a co-rotating scroll pump |
| G | Driven portion of a co-rotating scroll pump |
| H | Scroll pump outlet |
| I | Hollow rotating shaft connecting pump to expander |

TABLE 1-continued

| FIG. 1 Identifiers | |
|---|---|
| Identifier | Item Description |
| J | Generator rotor |
| K | Generator stator |
| L | Heat transfer fins transferring heat between (I) and (N) |
| M | Heat source fluid inlet |
| N | Spiral fluid path for heat source fluid |
| O | Heat source fluid outlet |
| P | Scroll expander inlet |
| Q | Containment shell housing all components (can include fins on outside) |
| State Points between Components (Numbered Squares) | |
| 1 | Low pressure liquid refrigerant after condensation and before pumping |
| 2 | High pressure liquid refrigerant after pumping and before evaporation |
| 3 | High pressure refrigerant gas, after evaporation and before expansion |
| 4 | Low pressure single or two phase refrigerant gas after expansion before condensation |
| Processes (broken lines) | |
| A5 | Pumping process |
| B5 | Evaporation process |
| C5 | Expansion process |
| D5 | Condensation process |

From the foregoing, it should be apparent to those skilled in the art that the scroll expander of FIG. 1 thus comprises the components marked therein by the identification symbols circled-A through circled-C and circle-P, that the scroll pump comprises circled-F through circled-H, and that the generator comprises circled-J through circled-K. It should be further apparent that the pumping process, marked or designated in FIG. 1 and by the foregoing as A5, occurs between numbered-square-1 and numbered-square-2; that the evaporation process, marked or designated in FIG. 1 and by the foregoing as B5, occurs between numbered-square-2 and numbered-square-3; that the expansion process, marked or designated in FIG. 1 and by the foregoing as C5, occurs between numbered-square-3 and numbered-square-4; and that the condensation process, marked or designated in FIG. 1 and by the foregoing as D5, occurs between numbered-square-1 and numbered-square-2.

The design and operation of individual components of such construction are well known and those skilled in the art will appreciate and understood from FIGS. 1, 5, and 6, and from the Tables associated therewith and the discussions hereinabove, how the various components are connected to one another to be operable and integrated within a common container, with various rotating components sharing a common shaft through which the working fluid flows while transiting between certain of the component devices.

The scroll expander operates to extract power from the working fluid provided thereto at numbered-square-3 and to move the working fluid into the condenser, as at numbered-square-4, while the scroll liquid pump operates to pump the working fluid provided from the condenser at numbered-square-1 to the evaporator at numbered-square-2 and through the evaporator to numbered-square-3. The pump, expander, and generator are aligned on the same shaft, with the evaporation process occurring inside the shaft and the condensation process occurring along the containment shell of the container housing. The end result of such preferred embodiment is the production of electrical energy by moving heat from a high temperature source to a low temperature source.

Figure 2:
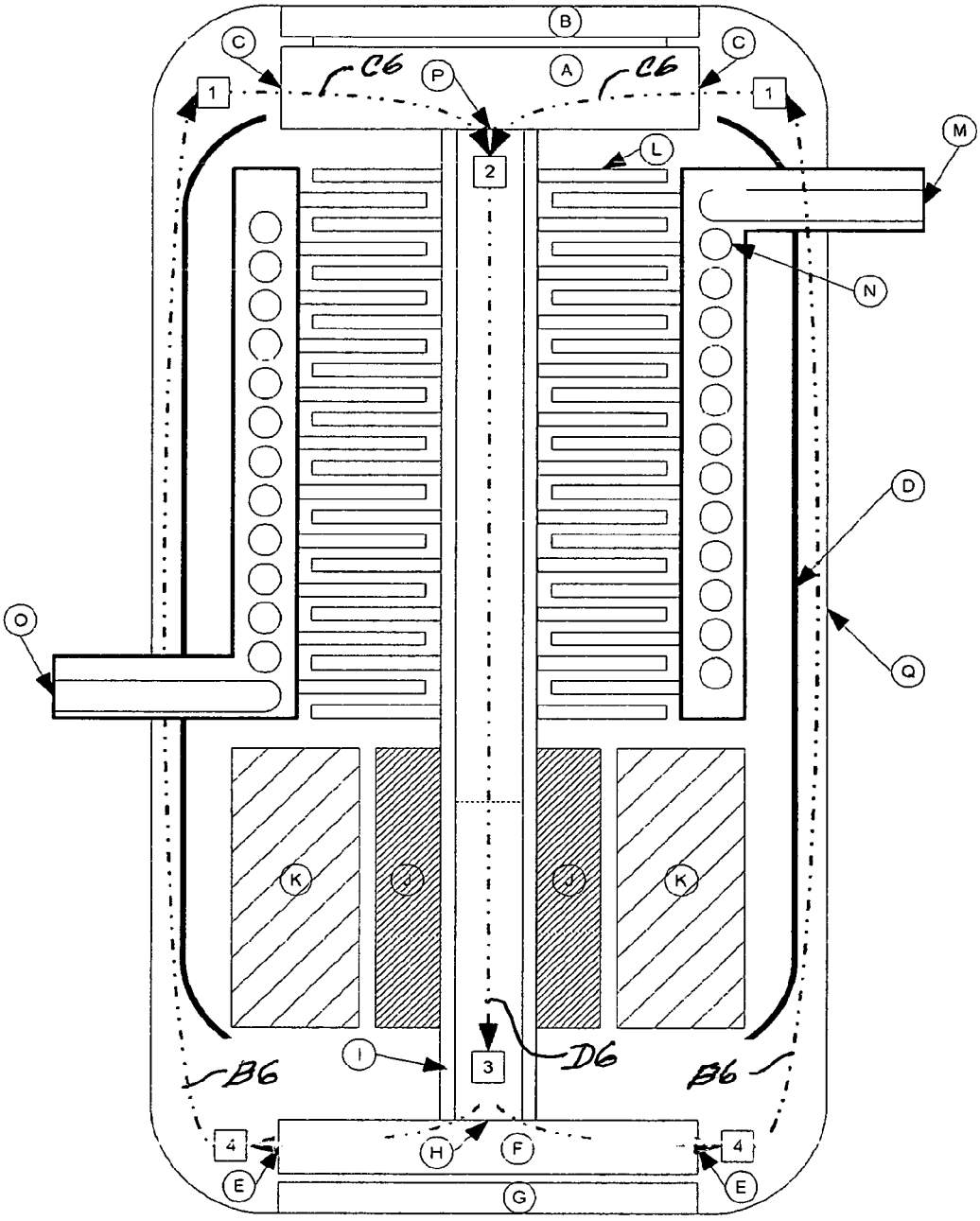
FIG. 2 depicts a preferred embodiment of the present invention as incorporated within a compact housing, operating as or in accordance with a Heat Pump or Refrigeration Cycle.

FIG. 2 depicts a preferred embodiment of the present invention, operating as or in accordance with a Heat Pump or Refrigeration Cycle, with components of such embodiment having the identification symbols as set forth in the following Table 2:

TABLE 2

| FIG. 2 Identifiers | |
|---|---|
| Identifier | Item Description |
| Components (Alphabetized circles) | |
| A | Orbiting portion of an orbital scroll compressor, or driving portion of a co-rotating scroll compressor |
| B | Fixed portion of an orbital scroll compressor, or driven portion of a co-rotating scroll compressor |
| C | Scroll compressor inlet |
| D | Insulation/sealing between evaporator and rotating equipment |
| E | Scroll liquid expander outlet |
| F | Driving portion of a co-rotating scroll liquid expander, or capillary tube or expansion valve |
| G | Driven portion of a co-rotating scroll liquid expander |
| H | Scroll liquid expander inlet |
| I | Hollow rotating shaft connecting compressor to liquid expander |
| J | Motor rotor |
| K | Motor stator |
| L | Heat transfer fins transferring heat between (I) and (N) |
| M | Heat sink fluid inlet |
| N | Spiral fluid path for heat sink fluid |
| O | Heat sink fluid outlet |
| P | Scroll compressor outlet |
| Q | Containment shell housing all components (can include fins on outside) |
| State Points between Components (Numbered Squares) | |
| 1 | Low pressure refrigerant gas after evaporation and before compression |
| 2 | High pressure refrigerant gas after compression and before condensation |
| 3 | High pressure liquid refrigerant after condensation and before expansion |
| 4 | Low pressure two phase refrigerant gas after expansion before evaporation |
| Processes (broken lines) | |
| A6 | Expansion process |
| B6 | Evaporation process |
| C6 | Compression process |
| D6 | Condensation process |

From the foregoing, it should be apparent to those skilled in the art that the scroll compressor of FIG. 2 thus comprises the components marked therein by the identification symbols circled-A through circled-C and circle-P, that the scroll expander comprises circled-F through circled-H, and that the motor comprises circled-J through circled-K. It should be further apparent that the expansion process, marked or designated in FIG. 2 and by the foregoing as A6, occurs between numbered-square-3 and numbered-square-4; that the evaporation process, marked or designated in FIG. 2 and by the foregoing as B6, occurs between numbered-square-4 and numbered-square-1; that the compression process, marked or designated in FIG. 2 and by the foregoing as C6, occurs between numbered-square-1 and numbered-square-2; and that the condensation process, marked or designated in FIG. 2 and by the foregoing as D6, occurs between numbered-square-2 and numbered-square-3.

The design and operation of individual components of such construction are well known and those skilled in the art will appreciate and understood from FIGS. 2, 5, and 6, and from the Tables associated therewith and the discussions hereinabove, how the various components are connected to one another to be operable and integrated within a common container, with various rotating components sharing a common shaft through which the working fluid flows while transiting between certain of the component devices.

The scroll compressor operates to compress the working fluid provided thereto from the evaporator at numbered-square-1 and to move the working fluid into the condenser, as at numbered-square-2, while the scroll expander operates to expand the working fluid provided as a liquid from the condenser at numbered-square-3 and to provide it to the evaporator at numbered-square-4 as a two-phase gas. The expander, compressor, and motor are aligned on the same shaft, with the condensation process occurring inside the shaft and the evaporation process occurring along the containment shell of the container housing. The end result of such preferred embodiment is the use of electrical energy to move heat from a low temperature source to a high temperature source. For a heat pump cycle, refrigerant can be used as the working fluid to move heat from ambient air to a heated area. For a refrigeration cycle, refrigerant can be used to remove heat from a cooled area to the ambient air.

Figure 3:
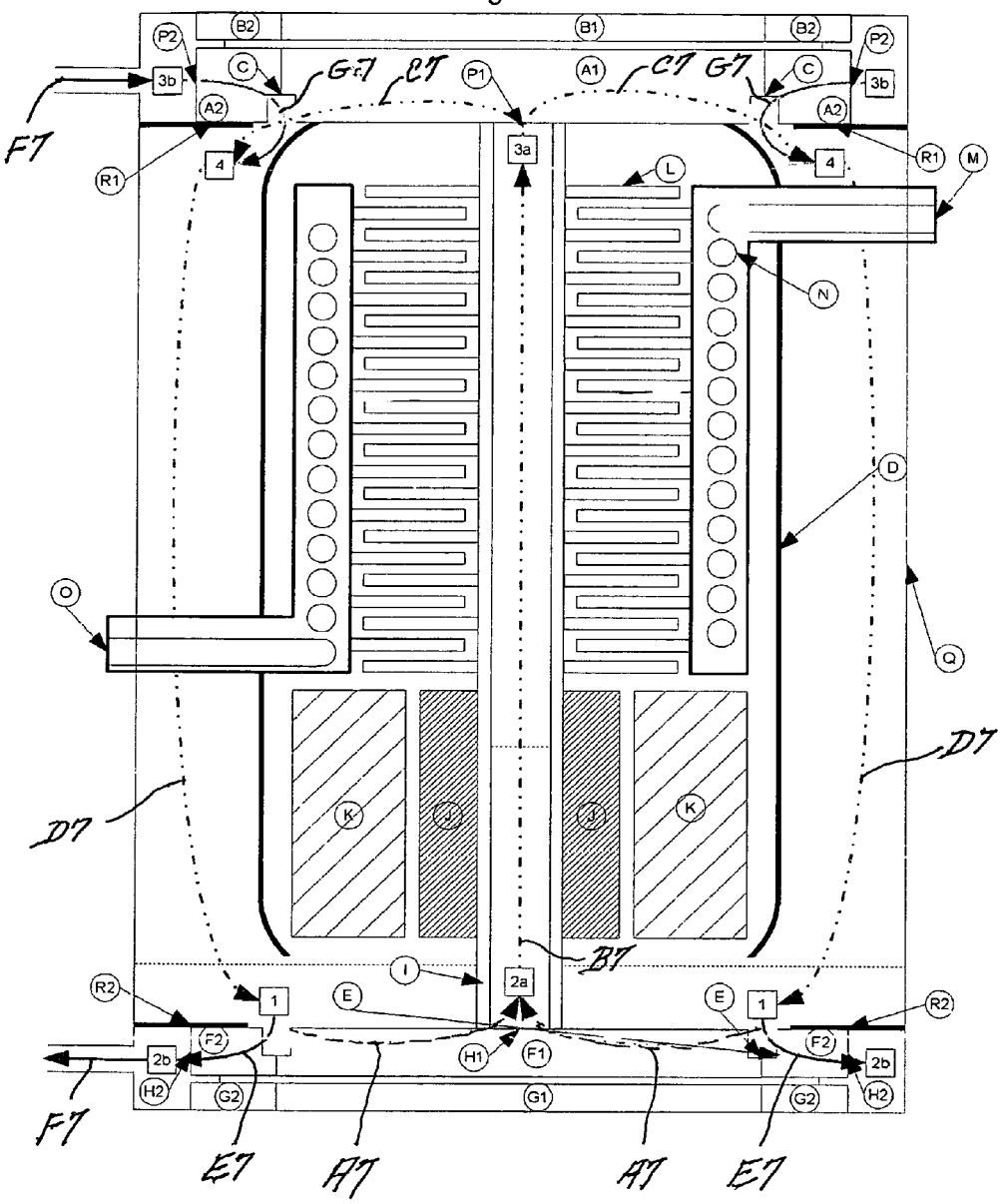
FIGS. 3 and 4 depict a preferred embodiment of the present invention as incorporated within a compact housing, operating as or in accordance with a Combined Refrigeration and Organic Rankine Cycle (ORC)
Figure 4:
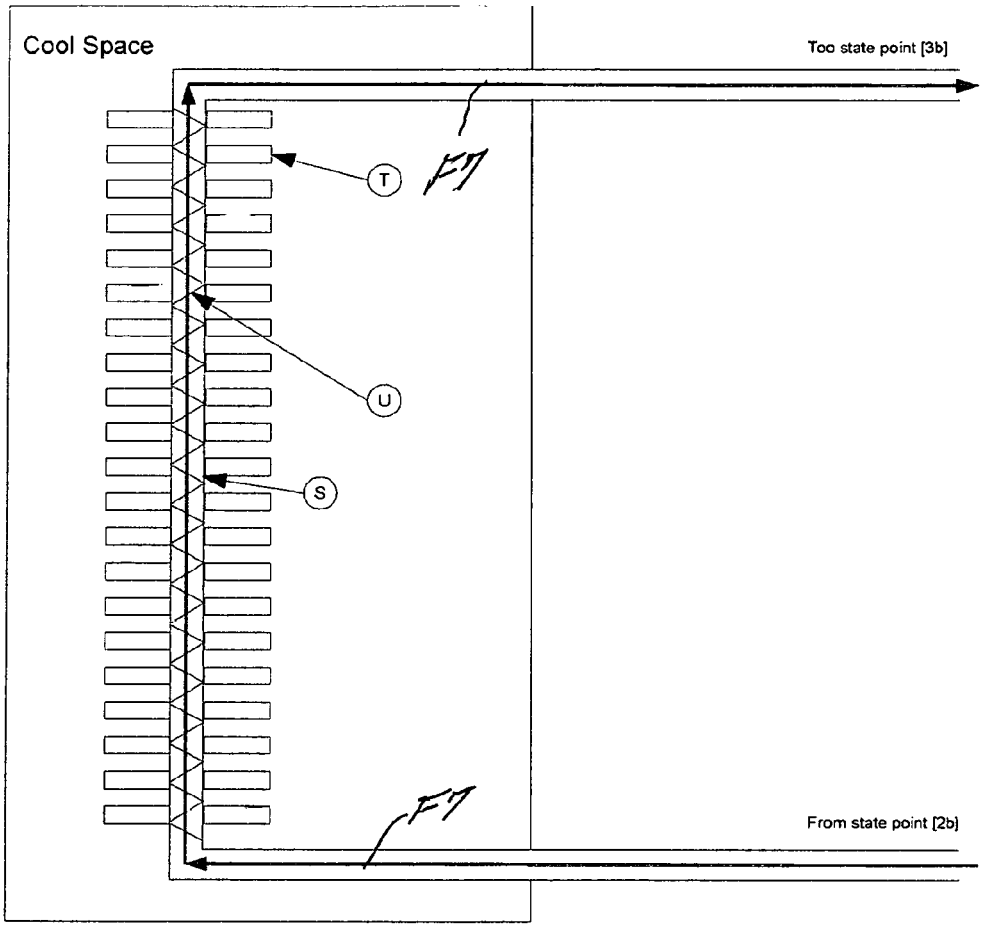

FIGS. 3 and 4 depict a preferred embodiment of the present invention as incorporated within a compact housing, operating as or in accordance with a Combined Refrigeration and Organic Rankine Cycle, with components of such embodiment having the identification symbols as set forth in the following Table 3:

TABLE 3

| FIGS. 3 and 4 Identifiers | |
|---|---|
| Identifier | Item Description |
| Components (Alphabetized circles) | |
| A1 | Rotating or orbital expander portion of the scroll compressor-expander |
| B1 | Fixed or co-rotating expander portion of the scroll compressor-expander |
| A2 | Rotating or orbital compressor portion of the scroll compressor-expander |
| B2 | Fixed or co-rotating compressor portion of the scroll compressor-expander |
| C | Scroll compressor-expander outlet |
| D | Insulation/sealing between condenser and rotating equipment |
| E | Scroll pump-expander inlet |
| F1 | Rotating pump portion of the scroll pump-expander |
| G1 | Fixed pump portion of the scroll pump-expander |
| F2 | Rotating expander portion of the scroll pump-expander |
| G2 | Fixed expander portion of the scroll pump-expander |
| H1 | Scroll pump outlet or the pump-expander |
| H2 | Scroll expander outlet or the pump-expander |
| I | Hollow rotating shaft connecting pump-expander to compressor-expander |
| J | Generator/motor rotor |
| K | Generator/motor stator |
| L | Heat transfer fins transferring heat between (I) and (N) |
| M | Heat source fluid inlet |
| N | Spiral fluid path for heat source fluid |
| O | Heat source fluid outlet |
| P1 | Scroll expander inlet of the compressor-expander |
| P2 | Scroll compressor inlet of the compressor-expander |
| Q | Containment shell housing all components (can included fins on outside) |
| R1 | Insulation/sealing between compressor inlet and condensation process |
| R2 | Insulation/sealing between expander outlet and condensation process |
| S | Low pressure evaporator |
| T | Low pressure evaporator external fin configuration |
| U | Low pressure evaporator internal spiral fin configuration |

TABLE 3-continued

| FIGS. 3 and 4 Identifiers | |
|---|---|
| Identifier | Item Description |
| State Points between Components (Numbered Squares) | |
| 1 | Intermediate pressure liquid refrigerant after condensation and before pumping or expansion |
| 2a | High pressure liquid refrigerant after pumping and before high pressure evaporation |
| 2b | Low pressure two phase refrigerant gas after expansion and before low pressure evaporation |
| 3a | High pressure refrigerant gas after high pressure evaporation and before expansion |
| 3b | Low pressure refrigerant gas after low pressure evaporation and before compression |
| 4 | Low pressure refrigerant gas after expansion or compression and before condensation |
| Processes (broken/solid lines) | |
| A7 (broken line) | Intermediate pressure to high pressure pumping process |
| B7 (broken line) | High pressure evaporation process |
| C7 (broken line) | High pressure to intermediate pressure expansion process |
| D7 (broken line) | Intermediate condensation process |
| E7 (solid line) | Intermediate pressure to low pressure expansion |
| F7 (solid line) | Low pressure evaporation process |
| G7 (solid line) | Low pressure to intermediate pressure compression |

From the foregoing, it should be apparent to those skilled in the art that the scroll compressor-expander of FIGS. 3-4, which may take a form as disclosed in U.S. Provisional Patent Application Ser. No. 61/574,771, filed Aug. 9, 2011, thus comprises the components marked therein by the identification symbols circled-A1 through circled-B1, circled-A2 through circled-B2, circled-C, and circled-P1 through circled P2; that the scroll pump-expander, which may also take a form as disclosed in U.S. Provisional Patent Application Ser. No. 61/574,771, filed Aug. 9, 2011 (DN8108), comprises circled-F1 through circled-H1 and circled-F2 through circled-H2; and that the generator/motor comprises circled-J through circled-K.

It should be further apparent that the intermediate pressure to high pressure pumping process, marked or designated in FIG. 3 and by the foregoing as A7 (broken line), occurs between numbered-square-1 and numbered-square-2*a*; that the high pressure evaporation process, marked or designated in FIG. 3 and by the foregoing as B7 (broken line), occurs between numbered-square-2*a* and numbered-square-3*a*; that the high pressure to intermediate pressure expansion process, marked or designated in FIG. 3 and by the foregoing as C7 (broken line), occurs between numbered-square-3*a* and numbered-square-4; that the intermediate condensation process, marked or designated in FIG. 3 and by the foregoing as D7 (broken line), occurs between numbered-square-4 and numbered-square-1; that the intermediate pressure to low pressure expansion process, marked or designated in FIG. 3 and by the foregoing as E7 (solid line), occurs between numbered-square-1 and numbered-square-2*b*; that the low pressure evaporation process, marked or designated in FIGS. 3 and 4 and by the foregoing as F7 (solid line), occurs between numbered-square-2*b* on FIG. 3 and through FIG. 4 back to numbered-square-3*b* on FIG. 3; and that the low pressure to intermediate pressure compression process, marked or designated in FIG. 3 and by the foregoing as G7 (solid line), occurs between numbered-square-3*b* and numbered-square-4.

The design and operation of individual components of such construction are known from the prior art and/or from U.S. Provisional Patent Application Ser. No. 61/574,771, filed Aug. 9, 2011 (DN8108), incorporated herein by reference thereto, and those skilled in the art will appreciate and understood from FIGS. 3-6, and from the Tables associated therewith and the discussions hereinabove, how the various components are connected to one another to be operable and integrated within a common container, with various rotating components sharing a common shaft through which the working fluid flows while transiting between certain of the component devices.

The outer portion of the compressor-expander of FIG. 3 operates to compress refrigerant provided thereto at numbered-square-3*b* on FIG. 3 from the low pressure evaporator of FIG. 4 and to provide the compressed refrigerant to the intermediate pressure condenser at numbered-square-4 on FIG. 3, while the inner portion of such compressor-expander operates to expand refrigerant provided thereto at numbered-square-3*a* on FIG. 3 from the high pressure evaporator and to provide the expanded refrigerant to the intermediate pressure condenser at numbered-square-4. The manner in which both of such operations are affected by the compressor-expander of FIG. 3 is explained in greater detail in U.S. Provisional Patent Application Ser. No. 61/574,771, filed Aug. 9, 2011, which is incorporated herein by reference thereto.

Somewhat similarly, the outer portion of the pump-expander of FIG. 3 operates to expand liquid refrigerant provided at numbered-square-1 from the intermediate pressure condenser and to provide such expanded refrigerant at numbered-square-2*b* to the low pressure evaporator (FIG. 4), while the inner portion of such pump-expander operates to pump the liquid refrigerant provided thereto at numbered-square-1 to the high pressure evaporator at numbered-square-2*a*. The manner in which both of such operations are affected by the pump-expander of FIG. 3 is also explained in greater detail in U.S. Provisional Patent Application Ser. No. 61/574,771, filed Aug. 9, 2011, which is incorporated herein by reference thereto.

As can be observed from FIG. 3, the compressor-expander, motor/generator, and pump-expander are all located on the same shaft. The high pressure evaporation process occurs inside the hollow shaft while the intermediate pressure condensation process occurs along the inside of the containment shell. The low pressure evaporation process occurs in an evaporator component shell inside a cooled space, which may typically be located external to the containment, such as shown in FIG. 4, but which could also, with some redesign and/or segmentation of the areas within the containment shell between the outer housing circled-Q and the insulation circled-D, be included within such outer housing.

Figure 5:
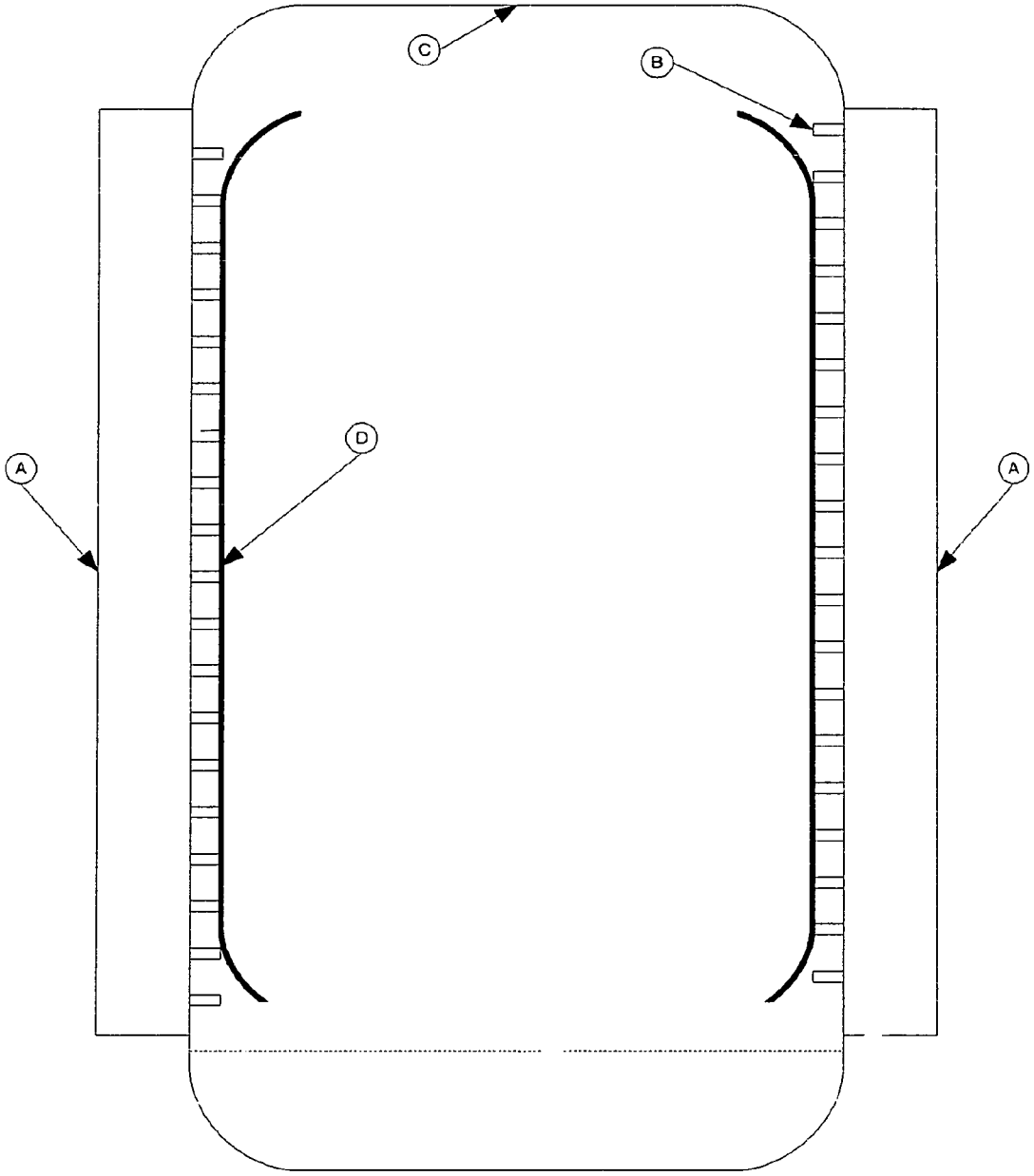
FIG. 5 shows a preferred housing fin configuration that can optionally be employed with the embodiments of FIGS. 1-4.

FIG. 5 shows a preferred housing fin configuration that can optionally be employed with the embodiments of FIGS. 1-4, with components thereof having the identification symbols as set forth in the following Table 4:

TABLE 4

FIG. 5 Identifiers for Housing Fin Configuration

| Identifier | Item Description<br>Components (Alphabetized circles) |
|---|---|
| A | External horizontal fins attached to the containment shell (C) |

TABLE 4-continued

FIG. 5 Identifiers for Housing Fin Configuration

| Identifier | Item Description<br>Components (Alphabetized circles) |
|---|---|
| B | Spiral fin between the inside wall of the containment shell (C) and the Insulation/sealing wall (D) |
| C | Containment Shell |
| D | Separation/sealing wall |

If desired by a user, an optional fin array construction circled-A can be readily added to the outside of the containment shell of FIG. 5. Although FIG. 5 shows a fin array construction in which a number of fins of a straight vertical fin configuration are disposed generally radially about the generally cylindrical containment shell circled-C, any suitable fin geometry/configuration could be utilized to optimize heat transfer. In addition, an external fan system (not shown) could optionally be included on the outside to add forced convection across the fin array.

A large spiral fin circled-B could also be added to the inside wall of the containment shell circled-C of FIG. 5. Although such fin is presented in FIG. 5 as being one fin having a spiral fin configuration, any fin geometry/configuration could be used to optimize heat transfer.

Figure 6:
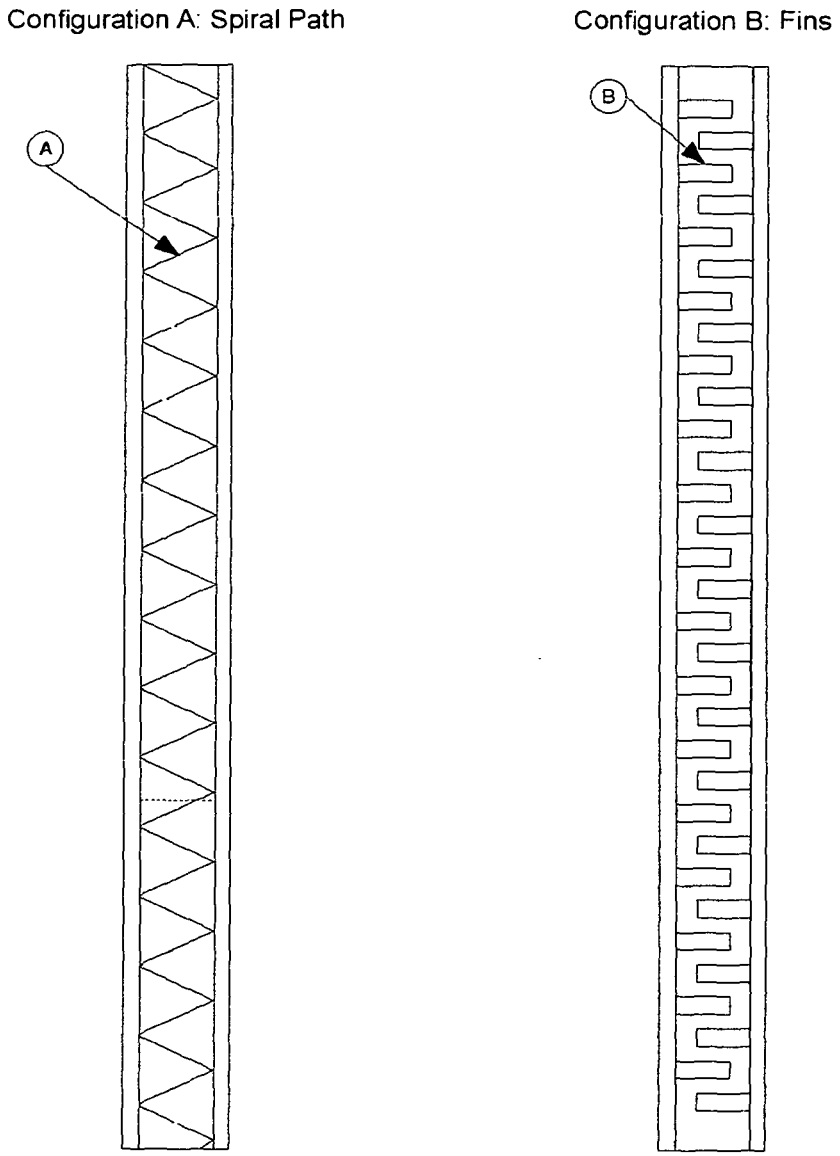
FIG. 6 shows several rotating shaft fin configurations that can be optionally employed with hollow shaft components such as are employed with the preferred embodiments of FIGS. 1-3.

FIG. 6 shows several rotating shaft fin configurations that can be optionally employed with hollow shaft components such as are employed with the preferred embodiments of FIGS. 1-3, with the components thereof having the identification symbols as set forth in the following Table 5:

TABLE 5

FIG. 6 Identifiers for Rotating Shaft Fin Configuration

| Identifier | Item Description<br>Components |
|---|---|
| A | Spiral fin spanning the entire length of the rotating shaft |
| B | Offset fins spanning the entire length of the rotating shaft |

A spiral fin system or channel can also optionally be added inside the hollow shaft in order to increase heat transfer surface area. Such fin systems can take various forms, including the two preferred, alternative configurations depicted in FIG. 6 as Configurations A and B. The fin system of Configuration A includes one spiral fin along the entire length while the fin system of Configuration B includes a series of offset fins.

Various other and additional changes and modifications are also possible. Among the changes and modifications contemplated is the use with the low pressure evaporator of a set of both external and internal fins, depicted as components circled-T and circled-U in FIG. 4, to increase surface area. Such fins can be any configuration/geometry to optimize heat transfer. It is envisioned that, in at least some instances, an off the shelf evaporator could be used as the external low pressure evaporator component.

It is also envisioned that, in order to minimize overall cost, the expander of FIG. 2 could be replaced with a capillary tube. Although such a substitution would lower overall efficiency, it would lower system cost substantially. Similarly, the expander component in the pump-expander of FIG. 3 could be replaced with a capillary tube to decrease system cost.

In light of all the foregoing, it should thus be apparent to those skilled in the art that there has been shown and described a compact energy cycle construction of a unique design that integrates within a compact container rotating components that share a common shaft along which working fluid transits between rotary working fluid treatment devices to flow toroidally within the container as the construction operates as or in accordance with an energy cycle. However, it should also be apparent that, within the principles and scope of the invention, many changes are possible and contemplated, including in the details, materials, and arrangements of parts which have been described and illustrated to explain the nature of the invention. Thus, while the foregoing description and discussion addresses certain preferred embodiments or elements of the invention, it should further be understood that concepts of the invention, as based upon the foregoing description and discussion, may be readily incorporated into or employed in other embodiments and constructions without departing from the scope of the invention. Accordingly, the following claims are intended to protect the invention broadly as well as in the specific form shown, and all changes, modifications, variations, and other uses and applications which do not depart from the spirit and scope of the invention are deemed to be covered by the invention, which is limited only by the claims which follow.

I claim:

1. A compact energy cycle construction that utilizes a working fluid in its operation, comprising:

a compact housing of a cylindrical form, a plurality of energy cycle devices disposed within said housing and interconnected to form an integrated system operable in accordance with an energy cycle, at least two of which energy cycle devices share a common rotatable hollow shaft;

an evaporator located within the rotatable hollow shaft;

said energy cycle device is one of a Rankine Cycle, an Organic Rankine Cycle, a Heat Pump Cycle, or a Combined Heat Pump and Organic Rankine Cycle;

said rotatable hollow shaft includes a central passageway therethrough for the transit through said hollow shaft of the working fluid;

said system effecting circulation of the working fluid in a torus within said housing as said system operates, and the working fluid flowing through the rotatable hollow shaft for an evaporation process of the working fluid to take place within the rotatable hollow shaft and the working fluid flowing within the housing in a first path and a second path for a condensation process of the working fluid to take place, the first path and the second path sharing the evaporator but having distinct condenser flow paths; and a heat transfer portion in the energy cycle construction that employs a heat transfer fluid during its operation, said heat transfer portion disposed along said hollow shaft and including a heat transfer fluid conduit spirally wrapped about said hollow shaft, said conduit being spaced outwardly from said hollow shaft to define a space therebetween and having a fluid inlet and a fluid outlet, and heat transfer fins disposed along said hollow shaft and said conduit in the space therebetween.

2. The construction of claim 1 wherein said plurality of energy cycle devices includes a scroll type expander, a generator, and a pump, all sharing said common rotatable hollow shaft.

3. The construction of claim 2 wherein said generator is disposed along said common rotatable hollow shaft intermediate said expander and said pump.

4. The construction of claim 3 wherein said system operates in accordance with one of a Rankine Cycle or Organic Rankine Cycle.

5. The construction of claim 4 wherein said compact housing includes an outer working fluid passageway along the inside of said compact housing between said expander and said pump, with condensation occurring along said passageway and evaporation occurring along the interior of said rotatable hollow shaft as said system operates.

6. The construction of claim 5 wherein said compact housing has an external fin array disposed about the periphery of said compact housing.

7. The construction of claim 6 wherein said compact housing has a generally cylindrical configuration and said external fin array includes a plurality of fins of a straight vertical fin configuration extending radially from said compact housing.

8. The construction of claim 7 wherein said compact housing includes an inner wall surface and an internal fin construction disposed about said inner wall surface.

9. The construction of claim 8 wherein said internal fin construction includes a spiral fin extending along said inner wall surface.

10. The construction of claim 9 including a fin system disposed in and along said central passageway of said hollow shaft.

11. The construction of claim 10 wherein said fin system includes a spiral fin extending along at least a portion of said central passageway.

12. The construction of claim 10 wherein said fin system includes a series of offset fins along at least a portion of said central passageway.

* * * * *